US009661883B2

(12) United States Patent
Neale

(10) Patent No.: US 9,661,883 B2
(45) Date of Patent: May 30, 2017

(54) HAND-TOOL BRACE

(71) Applicant: The Boeing Company, Chicago, IL (US)

(72) Inventor: Andrew Lawrence Neale, Saint Louis, MO (US)

(73) Assignee: The Boeing Company, Chicago, IL (US)

( * ) Notice: Subject to any disclaimer, the term of this patent is extended or adjusted under 35 U.S.C. 154(b) by 0 days.

(21) Appl. No.: 15/000,986

(22) Filed: Jan. 19, 2016

(65) Prior Publication Data

US 2016/0128397 A1 May 12, 2016

Related U.S. Application Data

(62) Division of application No. 13/939,447, filed on Jul. 11, 2013, now Pat. No. 9,266,231.

(51) Int. Cl.

| | |
|---|---|
| ***A41D 13/08*** | (2006.01) |
| ***B25G 1/01*** | (2006.01) |
| ***B25G 3/20*** | (2006.01) |
| ***A41D 13/015*** | (2006.01) |
| ***B25F 5/00*** | (2006.01) |

(52) U.S. Cl.

CPC ..... *A41D 13/08* (2013.01); *A41D 13/015* (2013.01); *B25F 5/006* (2013.01); *B25G 1/01* (2013.01); *B25G 3/20* (2013.01); *A41D 2600/20* (2013.01); *Y10T 16/502* (2015.01)

(58) Field of Classification Search

CPC . B25G 1/01; B25G 1/10; B25G 1/102; B25G 3/20; B25G 3/24; B25F 5/02; B25F 5/006; A61F 5/013; B25D 17/04; B25D 17/043; A01B 1/026; B05C 17/0205; A41D 13/08; A41D 13/015

USPC ..... 16/430, 422, 426, 427, DIG. 25, 440; 30/298

See application file for complete search history.

(56) References Cited

U.S. PATENT DOCUMENTS 712,843 A * 11/1902 Paul ..... E21B 11/005 173/168
1,664,804 A * 4/1928 Allen ..... F16P 1/00 2/11
2,482,589 A * 9/1949 Maguire ..... B25G 1/102 15/143.1
3,773,375 A * 11/1973 Nehls ..... E04D 13/106 15/105
4,190,902 A * 3/1980 Rhee ..... A41D 13/08 2/16
4,619,047 A * 10/1986 Heckman ..... A22B 5/165 30/276
D290,220 S * 6/1987 Eckman ..... D8/71
4,677,971 A * 7/1987 Lindemann ..... A61F 5/013 473/62
4,924,571 A * 5/1990 Albertson ..... A01G 3/08 224/222
4,924,924 A * 5/1990 Stewart ..... B27C 7/06 142/36

(Continued)

*Primary Examiner* — Jeffrey O Brien
(74) *Attorney, Agent, or Firm* — Kunzler Law Group, PC

(57) ABSTRACT

A method and apparatus for transferring vibration of a motorized hand tool from a wrist to a forearm of a human operator is disclosed. The apparatus includes a connector that is coupled to the motorized hand tool and also includes a brace that is coupled to the forearm of the human operator and is also coupled to the connector.

20 Claims, 7 Drawing Sheets

(56) References Cited

U.S. PATENT DOCUMENTS 4,996,773 A * 3/1991 Albertson ..... A01G 3/08 30/121
5,025,560 A * 6/1991 Townsend ..... A22B 3/10 30/198
5,031,323 A * 7/1991 Honsa ..... B25F 5/021 30/276
5,156,429 A * 10/1992 Adams ..... B25F 5/021 16/422
5,275,068 A * 1/1994 Wrench ..... A01B 1/22 30/296.1
5,379,758 A * 1/1995 Snyder ..... A61B 17/02 15/143.1
5,455,981 A * 10/1995 Wiese ..... A47L 13/022 15/143.1
5,471,698 A * 12/1995 Francis ..... A47L 13/08 15/144.1
5,471,700 A * 12/1995 Pereira ..... A47L 13/022 15/143.1
5,653,680 A * 8/1997 Cruz ..... A61F 5/013 482/45
5,661,960 A * 9/1997 Smith ..... A01D 34/902 30/276
5,662,594 A * 9/1997 Rosenblatt ..... A61F 5/013 2/16
5,685,830 A * 11/1997 Bonutti ..... A61F 5/013 601/33
5,716,087 A * 2/1998 Backich ..... A01B 1/02 16/422
5,802,960 A * 9/1998 Graj ..... A47J 45/06 126/373.1
5,810,408 A * 9/1998 Armstrong ..... A01B 1/00 16/422
5,890,259 A * 4/1999 Sarac ..... A01B 1/00 16/422
5,916,186 A * 6/1999 Turto ..... A61F 5/0118 602/12
5,937,627 A * 8/1999 McKittrick ..... A01B 1/00 172/378
6,029,321 A * 2/2000 Fisher ..... F41C 33/001 124/35.2
6,066,079 A * 5/2000 McDaniel ..... E04D 15/04 492/13
6,082,795 A * 7/2000 Fornelli ..... A01B 1/00 16/422
6,189,222 B1 * 2/2001 Doyle ..... B26B 21/523 15/144.1
6,241,415 B1 * 6/2001 Stark ..... A47J 45/066 16/110.1
6,324,728 B1 * 12/2001 Blankenheim ..... B25F 5/021 16/110.1
6,435,284 B1 * 8/2002 Aman ..... A01B 1/00 172/371
6,464,272 B1 * 10/2002 Michaud ..... A01B 1/026 16/430
6,598,266 B1 * 7/2003 Elliott ..... A01B 1/00 16/426
6,698,064 B1 * 3/2004 Graj ..... A47J 45/071 16/422
6,852,067 B2 * 2/2005 Limonadi ..... A61B 5/1125 400/704
6,880,251 B2 * 4/2005 Gambert ..... B25F 5/02 30/276
7,093,667 B2 * 8/2006 Hurt ..... A01B 1/06 172/381
7,213,658 B2 * 5/2007 Hurt ..... A01B 1/06 172/381
7,284,301 B2 * 10/2007 Czuwala ..... B25G 1/102 16/430
7,389,544 B1 * 6/2008 Biggerstaff ..... A41D 13/08 2/16
7,402,148 B2 * 7/2008 Brewer ..... A61F 5/013 602/16
7,464,441 B2 * 12/2008 Peach ..... B62B 1/18 16/430
7,543,725 B2 * 6/2009 Herzog ..... A01G 1/125 15/405
7,637,882 B2 * 12/2009 Carman, Jr. ..... A01B 1/00 16/422
7,657,973 B1 * 2/2010 Hermann ..... B62B 5/06 16/110.1
7,818,847 B1 * 10/2010 Hermann ..... B25G 1/00 16/110.1
7,841,998 B2 * 11/2010 Pomeroy ..... A61B 17/6425 602/16
7,866,004 B1 * 1/2011 Hermann ..... B62B 5/06 16/110.1
8,029,452 B2 * 10/2011 Kliewer ..... A61B 8/4281 128/845
8,348,874 B2 * 1/2013 Schiff ..... A61F 5/0125 16/221
8,472,129 B1 * 6/2013 Trask ..... G02B 25/005 359/803
8,776,648 B2 * 7/2014 Lee ..... B25G 1/102 16/426
8,910,407 B2 * 12/2014 Singh ..... F41C 23/06 42/71.02
9,463,108 B2 * 10/2016 Anglada ..... A61F 5/0118
2002/0005289 A1 * 1/2002 McKittrick ..... A01B 1/00 172/378
2002/0010975 A1 * 1/2002 Walsh ..... A46B 5/02 15/230.11
2002/0157215 A1 * 10/2002 Carman, Jr. ..... A01B 1/00 16/430
2003/0001400 A1 * 1/2003 Kelzer ..... A01B 1/00 294/57
2004/0007887 A1 * 1/2004 Elliott ..... A01B 1/00 294/58
2004/0084489 A1 * 5/2004 Murphey ..... A45F 5/00 224/221
2005/0177982 A1 * 8/2005 Parlante ..... A45F 5/1046 16/422
2005/0194157 A1 * 9/2005 Hurt ..... A01B 1/06 172/371
2005/0241838 A1 * 11/2005 Hurt ..... A01B 1/06 172/371
2006/0174449 A1 * 8/2006 Hughes ..... A61F 4/00 16/430
2006/0242797 A1 * 11/2006 Czuwala ..... B25G 1/102 16/430
2008/0168625 A1 * 7/2008 Peach ..... B62B 1/18 16/426
2009/0106943 A1 * 4/2009 Seratt ..... B23D 45/16 16/430
2009/0192511 A1 * 7/2009 Haffenreffer ..... A61B 17/02 606/53
2011/0099765 A1 * 5/2011 Youssefieh ..... A01D 7/00 16/430
2011/0112452 A1 * 5/2011 Schiff ..... A61F 5/0125 602/16
2011/0282253 A1 * 11/2011 Menon ..... B25J 9/0006 601/40
2012/0012677 A1 * 1/2012 Crossley, III ..... B05B 9/01 239/526
2012/0144964 A1 * 6/2012 Lee ..... B25G 1/102 81/489
2013/0296757 A1 * 11/2013 Kaphingst ..... A61F 5/013 602/20
2014/0261166 A1 * 9/2014 Brooks ..... B05C 17/0205 118/258
2016/0051388 A1 * 2/2016 Goldfarb ..... A61F 5/013 602/16
2016/0287422 A1 * 10/2016 Kelly ..... A61F 5/013
2016/0367392 A1 * 12/2016 Pflaster ..... A61F 5/0127

* cited by examiner

FA
206
232
200
210
214
212
204
C
SP
SS
S
226
217
228
208
H
216
WP
218
MH
220
222
224

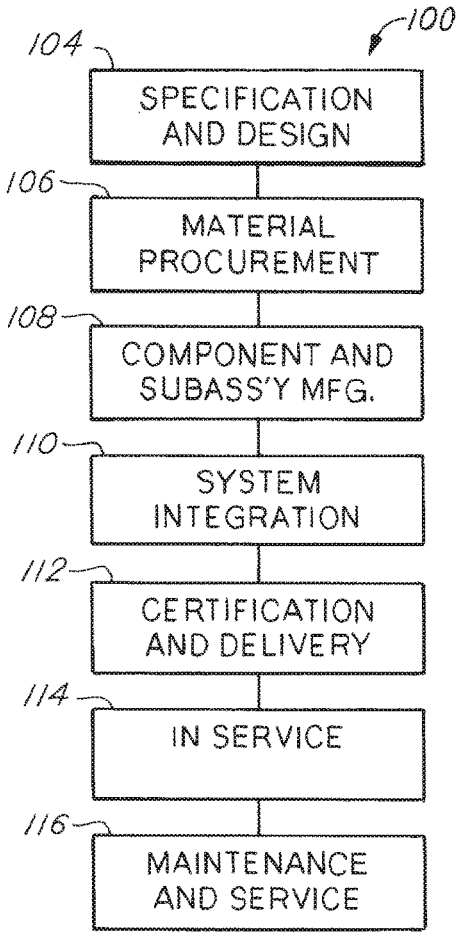
FIG.11
FIG.12
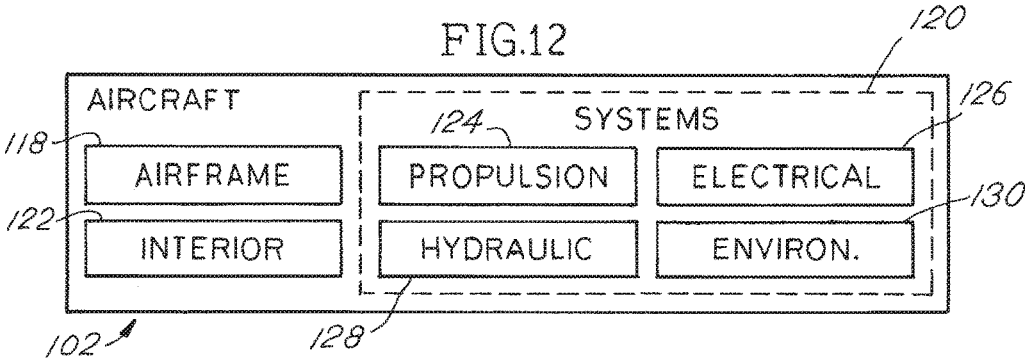

HAND-TOOL BRACE

BACKGROUND

Tools, both electrically powered and air powered, such as sanders, drills, saws and the like, are widely used in both industrial and consumer applications. It is generally known that prolonged usage of power tools may cause discomfort and fatigue.

More specifically, pressure and vibration from power tools may lead to discomfort in the operator's hands and wrist.

Cushioned gloves have been used in an attempt to address the above-identified issues. However, the pressure caused by exerting a force on the power tool still results in discomfort to the hand and wrist. An additional disadvantage of cushioned gloves is that their use reduces grip strength.

Tool balancers are helpful in reducing the overall effective tool weight. A disadvantage of tool balancers is that they cannot be used in certain situations. For example, a part being processed may be in a location that is beyond the effective reach of the power tool mounted on a tool balancer. Another disadvantage of tool balancers is that they are expensive to install and are not readily available to all operators.

Ergonomic features, e.g., tool handles, have also been used. However, ergonomic tools do not necessarily provide a useful advantage to all users. Hand sizes vary and an ergonomic tool may become uncomfortable if the physical characteristics of a particular operator are not within the design range of the ergonomic tool.

Further limitations and disadvantages of conventional approaches will become apparent to one of skill in the art, through comparison of such approaches with the present disclosure as set forth below with reference to the drawings.

BRIEF SUMMARY

Accordingly, a device for transferring the pressure and vibration of a hand-operated power tool from the wrist to the forearm of the operator may find utility.

In one aspect of the present disclosure, a device is provided for transferring the vibration of a power hand tool from the wrist to the forearm of the human operator. The device has a connector that is configured to be coupled to the power tool. A brace is configured to be coupled to the forearm of the human operator and the brace is coupled to the connector.

In another aspect of the present disclosure, a method is provided for transferring vibration of a power hand tool from the wrist to the forearm of a human operator. The method comprises providing a brace, coupling the brace to a connector, and coupling the brace to the forearm of the human operator. The method further comprises coupling the connector to the power hand tool.

The features, functions, and advantages that have been discussed can be achieved independently in various examples or may be combined in yet other examples, further details of which can be seen with reference to the following description and drawings.

BRIEF DESCRIPTION OF SEVERAL VIEWS OF THE DRAWINGS

FIG. 11 is a flow diagram of aircraft production and service methodology; and FIG. 12 is block diagram of an aircraft.

DETAILED DESCRIPTION

Figures 1, 2, 3, 6:
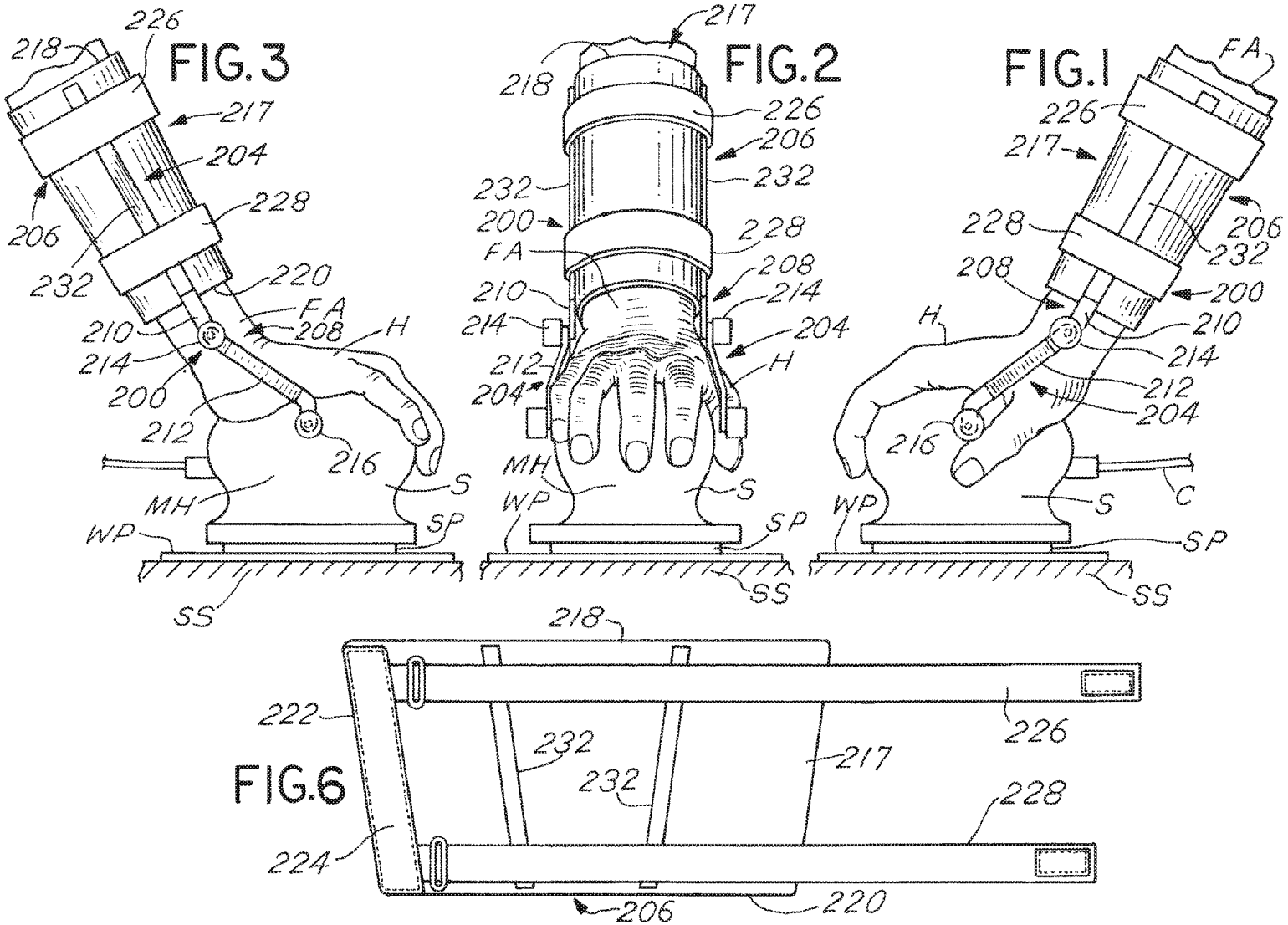
FIG. 1 is a right side view of the right hand of a human operator holding a power hand tool wherein a connector is attached to the power tool and is also coupled to a brace that is coupled to the forearm of the human operator.
FIG. 2 is a front view of the aspects shown in FIG. 1.
FIG. 3 is a left side view of the aspects shown in FIG. 1 and FIG. 2.
FIG. 6 is a plan view of a flexible wrap of the brace depicted in FIGS. 1-3 and 5.

Referring more particularly to the drawings, examples of the disclosure may be described in the context of an aircraft manufacturing and service method 100 as shown in FIG. 11 and an aircraft 102 as shown in FIG. 12. During pre-production, exemplary method 100 may include specification and design 104 of the aircraft 102 and material procurement 106. During production, component and subassembly manufacturing 108 and system integration 110 of the aircraft 102 takes place. Thereafter, the aircraft 102 may go through certification and delivery 112 in order to be placed in service 114. While in service by a customer, the aircraft 102 is scheduled for routine maintenance and service 116 (which may also include modification, reconfiguration, refurbishment, and so on).

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 12, the aircraft 102 produced by exemplary method 100 may include an airframe 118 with a plurality of systems 120 and an interior 122. Examples of high-level systems 120 include one or more of a propulsion system 124, an electrical system 126, a hydraulic system 126, and an environmental system 130. Any number of other systems may be included. Although an aerospace example is shown, the principles of the disclosure may be applied to other industries, such as the automotive industry.

Apparatus and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus example, method example, or a combination thereof may be utilized during the production stages 108 and 110, for example, by substantially expediting assembly of or reducing the cost of an aircraft 102. Similarly, one or more of apparatus example, method example, or a combination thereof may be utilized while the aircraft 102 is in service, for example and without limitation, to maintenance and service 116.

Referring to FIGS. 11 and 12, the description to be hereinafter provided generally falls within category 116 "Maintenance and Service" and also generally falls within both categories 118 "Airframe" and category 122 "Interior" of the aircraft.

The present description includes five examples of the disclosure. Each example will be described separately. Following is a listing of the device embodiments identifying the Figures depicting that particular example.

Each of the Examples is identified as follows:

(1) Device Example I—FIGS. 1-4 and 6;
(2) Device Example II—FIGS. 5, 5A and 6;
(3) Device Example III—FIGS. 7 and 6;
(4) Device Example IV—FIGS. 8 and 6; and
(5) Device Example V—FIGS. 9 and 10.

Device Example I

FIGS. 1-4 and 6

A device, generally 200, embodied as Device Example I, is illustrated, e.g., in FIGS. 1-3. The device 200 is structured to transfer pressure and vibration of a motorized hand tool, such as a motorized sander S, depicted in FIGS. 1-3, from the hand and wrist to the forearm of the user. The sander S is a type that is operated by downward pressure from the hand H of a human operator. As shown in FIGS. 1-3, the motorized sander S includes a motor housing MH, having an electric power cord C or an air connector operating the motor within the motor housing MH. Sandpaper SP of a type used with the sander S is attached to the movable base of the sander, operated by the motor. During operation of the sander S, such as a rotary sander, the sandpaper SP is sanding a workpiece WP resting on a support surface SS. Although a motorized sander S is shown and will be described herein, the motorized sander MH is only representative of one type of motorized hand tool that may be utilized with the device 200. As will be discussed herein, other hand tools, e.g., pistol-grip type motorized tools, such as drills, may be used with the device 200 to relieve stress, discomfort and fatigue of the human operator.

The device 200 includes a connector, generally 204, which may be coupled to the opposite sides of the motorized sander S. The device further includes a brace, generally 206, which may be coupled or attached to the forearm FA of the human operator. The brace 206 may be attached to the connector 204.

The connector 204 includes a pair of two-part linkages 208. Each linkage 208, as seen best in FIG. 2, includes a first link 210 which may be coupled to the forearm FA of the human operator by the brace 206. Each linkage 208 also includes a second link 212, which is pivotally interconnected at a pivot joint 214 to the first link 210. The lower end of each of the second links 212 may be pivotally coupled by a vibration absorber or mount 216 to the outer wall of the motor housing MH of the sander S.

The two linkages 208 may be mounted on opposite sides of the motor housing MH and may extend along the brace 206 on opposite sides of the operator's forearm FA. The use of two linkages 208 provides for balance and significant support in transferring vibration from both sides of the motor housing MH to both sides of the forearm FA of the operator.

Referring to FIG. 6, the brace 206 includes a flexible arm wrap 217 and is shown in an unfolded condition before being attached to the forearm FA of the human operator. The arm wrap 217 is used for coupling or attaching the device 200 to the forearm FA of an operator. The arm wrap 217 is shown having an upper edge 218 and a spaced lower edge 220. Because the arm wrap 217 may be mounted on a normally tapered forearm FA of a person, the unfolded arm wrap 217 has a trapezoidal shape. The upper edge 218 of the arm wrap 217 is longer than the lower edge 220. The arm wrap 217 includes an oblique lateral edge 222, which has a releasable fastener or strip 224 (such as a hook-and-loop fastener), mounted thereon. A complementary fastener (not shown) is provided on the opposite side of the strip 224 of the brace 206. Other releasable fasteners may also be used.

The brace 206 includes an upper cinch strap 226 positioned below the upper edge 218 of the brace 206. A lower cinch strap 228 is located just above the lower edge 220 of the brace 206. The cinch strap 226 may be wrapped around the upper portion of the forearm FA, while the lower cinch strap 228 may encircle the lower portion of the forearm FA of the human operator. The arm wrap 217 is preferably made of a flexible material, such as neoprene rubber.

As seen in FIG. 6 and in FIGS. 1-3, two mounting tubes 232, e.g. made of fabric, are attached to the arm wrap 217. An open space is provided within each of the mounting tubes 232, which are sized to receive the first links 210 of the linkages 208.

Figure 4:
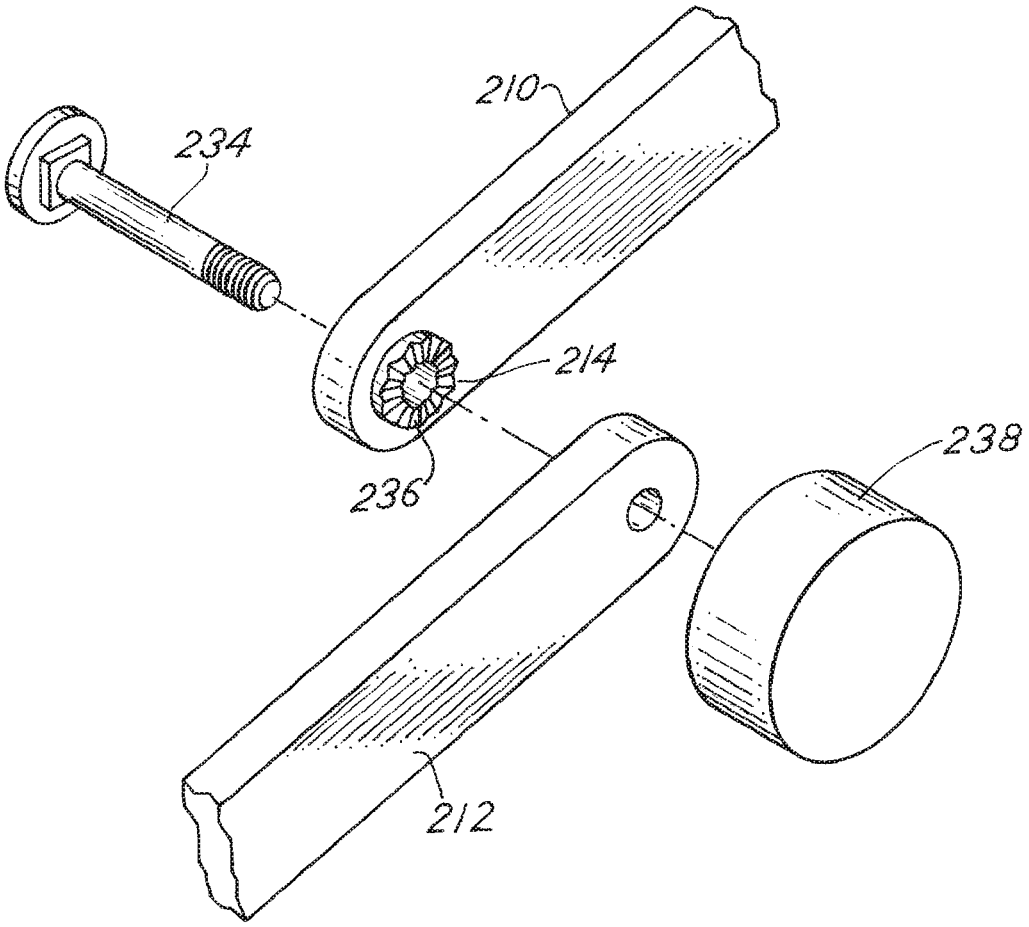
FIG. 4 is an exploded view showing two sections of the connector of FIGS. 1-3 that includes a locking mechanism.

Referring to FIG. 4, the pivot joint 214 is shown in detail and forms a lock. The first link 210 is provided with an outwardly facing ridged annular locking half 236 that faces a matching locking half (not shown) provided on the second link 212. A threaded securing bolt 234 is provided along the inner side of the first link 210 at the pivot joint 214 and is received by a threaded locking nut 238, as shown in FIGS. 1-4. The locking nut 238 locks the links 210 and 212 together upon mating of the two locking halves 236, thus providing a rigid interconnection between the first link 210 and the second link 212 at the pivot joint 214, e.g., during operation of the sander S.

To use the device 200, the connector 204 is secured to both sides of the motorized sander S. In addition, the brace 206 is coupled to the connector 204 on both sides of the forearm FA of the operator. The arm wrap 217 is secured to the forearm FA. The upper cinch strip 226 is placed around the upper forearm FA just below the elbow. The lower cinch strap 228 is placed around the forearm just above the wrist. Before the straps 226 and 228 are tightened, the first links 210 of each linkage 208 are received within the mounting tubes 232. The straps 226 and 228 are not tightened until such time as the lower ends the second links 212 are secured to opposite sides of the sander S by the vibration absorbers 216. The cinch straps 226 and 228 of the arm wrap 217 are then tightened around the forearm.

When the operator uses the sander S, much of the pressure and vibration from the operation of the sander S is transferred from the hand and wrist to the forearm FA of the operator, relieving stress and fatigue in the hand and the wrist. The transferred vibration from the sander S is spread across the area of the arm wrap 217 of the brace 202 and across the outer surface area of the forearm FA. Pressure normally directed from the sander S to the hand and the wrist is also channeled to the forearm through the linkages.

Device Example II

Figure 5:
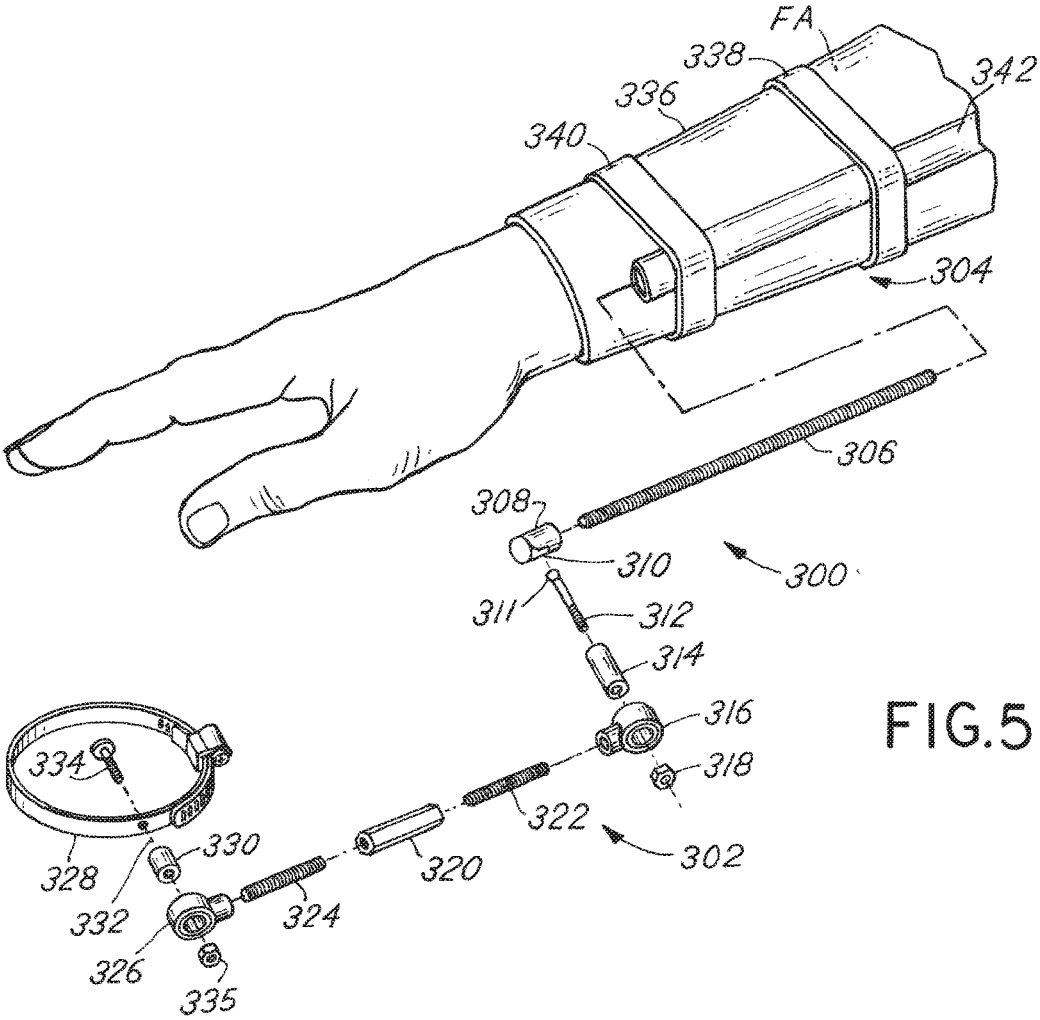
FIG. 5 is an alternate example of a connector that is coupled to the power hand tool and to the forearm of a human operator.
Figure 5A:
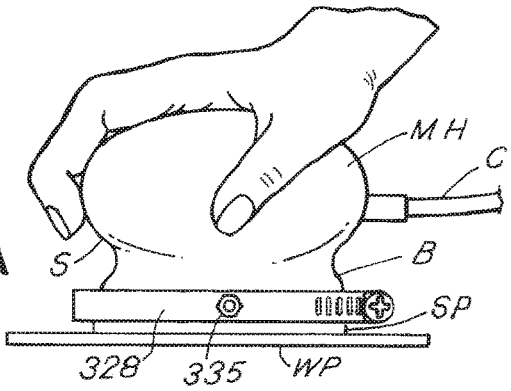
FIG. 5A is a side view showing the right hand of a human operator, the power hand tool, and an aspect of the example shown in FIG. 5.

FIGS. 5, 5A and 6

Referring to FIGS. 5, 5A and 6, a device 300 for transferring pressure and vibration of a motorized hand tool from the hand and wrist of the human operator to the forearm FA of the operator is shown. The device 300 includes a connector, generally 302, that may be coupled to a motorized sander S. For purposes of simplicity, FIGS. 5, 5A, and 6 illustrate only one side of the sander S and one side of a person's hand. It is to be understood that the connector 302 is mounted on both sides of the sander S and on both sides of a person's hand and arm.

A brace, generally 304, may be coupled or attached to the forearm FA of the human operator. The brace 304 may be coupled to the connector 302. A motorized sander S may be connected to the brace 304, which may be coupled or attached to the right forearm FA of an operator. The motorized sander S has a housing MH, which may include a power cord C, connected to an electrical power source. Sandpaper SP is mounted on the sander S for working on a workpiece WP as shown in FIG. 5A.

The connector 302 is shown in exploded view in FIG. 5. The connector 302 includes an upper threaded shaft 306, which is secured to the brace 304 in a manner to be described. The lower end of the threaded shaft 306 is threadably secured to a connector 308 along the central axis of the connector 308. The connector 308 includes a laterally mounted ball-and-socket joint 310. The connector 308 receives a ball 311 on a threaded stud 312, thereby providing a ball-and-socket joint 310 connection between the connector 308 and the stud 312. The stud 312 is received within a spacer 314. The threaded end of the stud 312 is secured to a connector 316 by a nut 318. The connector 316 includes a threaded portion that is transverse to the central axis of the stud 312, which is received within the connector 316. The central axis of the threaded portion of the connector 316 is aligned with an elongated, threaded adjustable center nut 320. The nut 320 receives an inner threaded shaft 322 and an outer threaded shaft 324. The center nut 320 includes a hexagonal outer surface that may be adjusted to set the overall combined length of the center nut 320 and the threaded shafts 322 and 324. The outer threaded shaft 324 is received by a connector 326 similar to the connector 316.

The connector 302 includes an adjustable clamp 328 that is secured to the base B of the sander S, as shown in FIG. 5A. The clamp 328 is attached to the connector 326 by a threaded bolt 334 that passes through an opening provided in the clamp 328. The bolt 334 passes through a spacer 330 and is secured to the connector 326 along a transverse axis 332 of the connector 326. The bolt 334 is secured to a nut 335 at the outer side of the connector 326. (For purposes of simplicity, FIG. 5A is shown without illustrating some parts shown in FIG. 5.).

The brace 304 includes an arm wrap 336, which includes an upper fastener strip 338 and a lower fastener strip 340. The strips 338 and 340 are secured to the arm wrap 336. As set forth above, both sides of the sander S and the forearm of an operator may be connected to a connector 302. Two mounting tubes 342 (one of which is not shown) are attached to the arm wrap 336 for receiving the threaded shafts 306 of the connector 302.

To use the device 300 with the sander S, the arm wrap 336 is placed around the forearm FA of the operator. The threaded shafts 306 are loosely placed within the mounting tubes 342. The connector 308 is threaded onto the lower end of the threaded shaft 306. The ball-and-socket joint 310 is interconnected to the first connector 316 and is secured thereto by the threaded stud 312 and the nut 318. The connector 316 is connected, by the combined threaded shafts 322 and 324 and the center nut 320, to the connector 326. The desired distance between the two connectors 316 and 326 is adjusted by rotating the center nut 320 in the appropriate direction. The clamp 328 is secured to the base B of the housing MH of the sander S. As described above, the connector 302 is secured to the opposite sides of the clamp 328.

When the connector 302 is assembled and loosely associated with the brace 304, the upper and lower strips 338 and 340 are tightened around the arm wrap 336, encircling the forearm of the user, to secure the connector 302 to the brace 304. The clamp 328 provides a direct connection to the sander S, as illustrated in FIG. 5A. Vibration and pressure from the sander S are transferred from the sander S by the connector 302 to the forearm FA of the operator during the sanding operation. Accordingly, the wrist and hand, which would normally receive pressure and vibration directly from the sander S, are relieved of substantial discomfort and fatigue by transferring the pressure and vibration from the sander S directly to the forearm FA of the operator.

Device Example III

Figure 7:
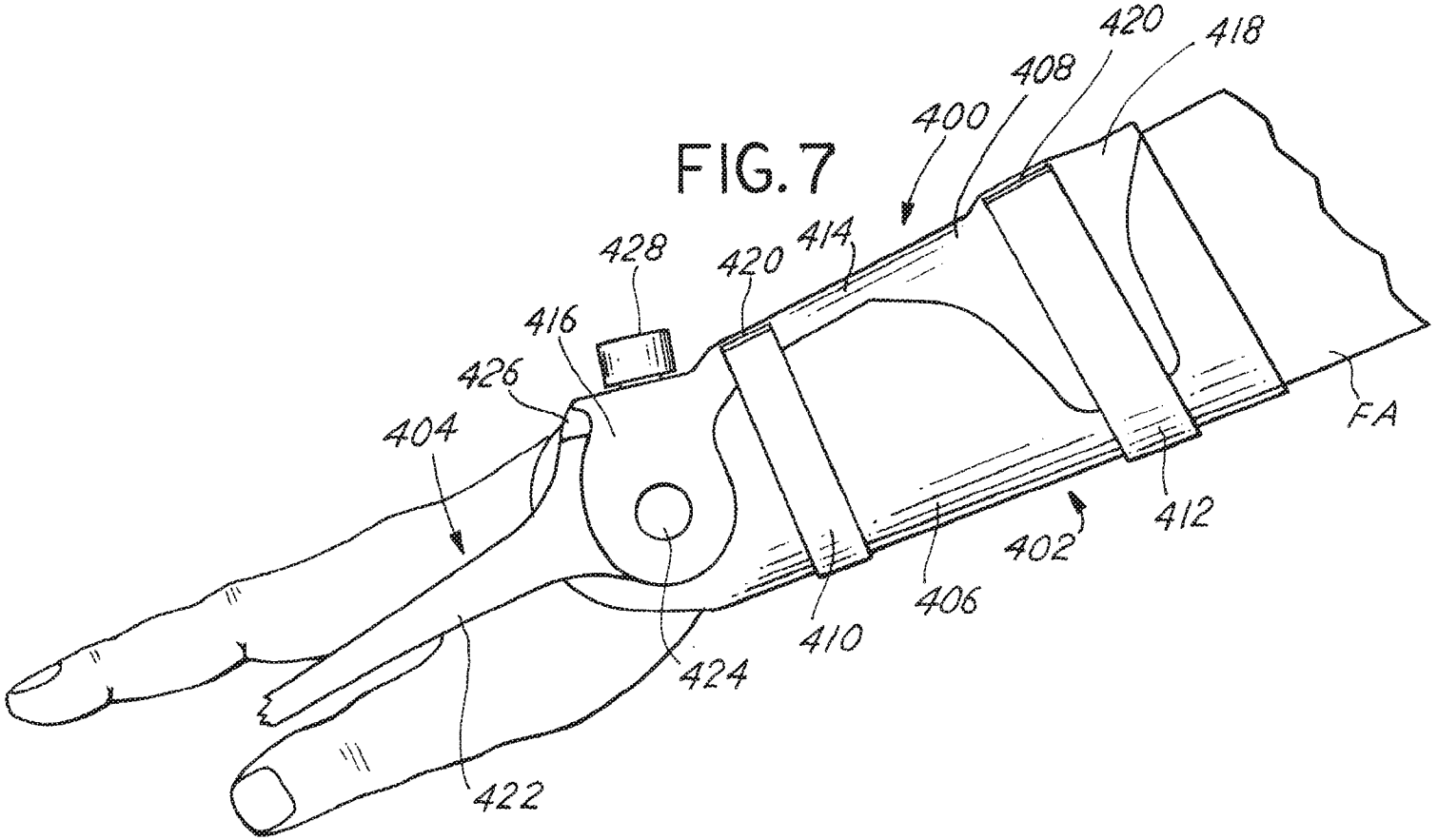
FIG. 7 is a side view of an alternative connector for coupling a power tool to the right forearm of a human operator.

FIGS. 7 and 6

A device, generally 400, for transferring pressure and vibration of a motorized hand tool, such as a sander, from the hand and wrist to the forearm FA of an operator is illustrated in FIG. 7. The principal difference in the device 400, as compared to the devices 200 and 300 described above, is the structure of the brace, generally 402. The connector, generally 404, is only partially shown in FIG. 7. The brace 402 generally includes an arm wrap 406 and an overlaying shell 408, which may be rigid or semi-rigid. A lower cinch strap 410 and an upper cinch strap 412 secure the shell 408 to the arm wrap 406 that also protectively covers the forearm FA of the operator.

The shell 408 includes an upper wall 414 that is sized and shaped to rest on the arm wrap 406 which overlays the surface of the forearm FA of the operator. The shell 408 further includes a connection section comprising a pair of unitary front legs 416 and a pair of unitary rear legs 418 (only one leg 416 and one leg 418 on one side being shown in FIG. 7). The shell 408 is designed to straddle the forearm FA and the arm wrap 406 protects the skin of the operator. The cinch straps 410 and 412 are received in slots 420 in the upper wall 414 of the shell 408. The straps 410 and 412 secure the shell 408 and the arm wrap 406 to the forearm FA of the operator.

Each of the front legs 416 pivotally receives one of the two links 422 (second link not shown) of the connector 404 at a pivot joint 424. The links 422 may also be connected to the sander S, e.g., in the same manner as the previously described devices 200 and 300.

A damping bumper 426 is mounted between the upper end of the link 422 and the underside of the lower end of the upper wall 414 of the shell 408. A bumper-adjuster knob 428 is mounted on the front central section of the upper wall 414 of the shell 408. The knob 428 adjusts the position of the damping bumper 426 to reduce the amount of vibration that is being transferred to the shell 408 from the sander S.

To place the device 400 in service, the arm wrap 406 is loosely positioned on the forearm FA of the operator. The shell 408 is placed in a straddling position over the arm wrap 406 and over the forearm FA. The arm wrap 406 may, alternatively, be attached to the shell 408 by an adhesive or other fastener systems. The front legs 416 of the shell 408 are mounted in a comfortable position on the forearm FA. The pivot joint 424 of the shell 408 is aligned at the wrist area of the operator. The operator secures the straps 410 and 412 to the forearm FA, to the arm wrap 406, and to the shell 408. The damping bumper 426 is adjusted to a desired position by the adjusting knob 428.

Much of the pressure and vibration from the motorized sander S is transferred from the wrist and hand of the operator to the shell 408 and thereby to the forearm FA of the operator. The damping bumper 426 further absorbs the transfer of pressure and vibration from the linkage of the connector 404 to the shell 408. The arm wrap 406, the shell 408, and the damping bumper 426 all cooperate to reduce pressure and vibration transmitted to the hand and wrist of the operator even further, as such pressure and vibration will have been absorbed by the damping bumper 426 and transmitted to the brace 402 and the operator's forearm. The brace 402 may be provided in different sizes depending on the size of the operator's forearm. The shell 408 may have a molded plastic construction and may also be provided in varying sizes.

Device Example IV

Figure 8:
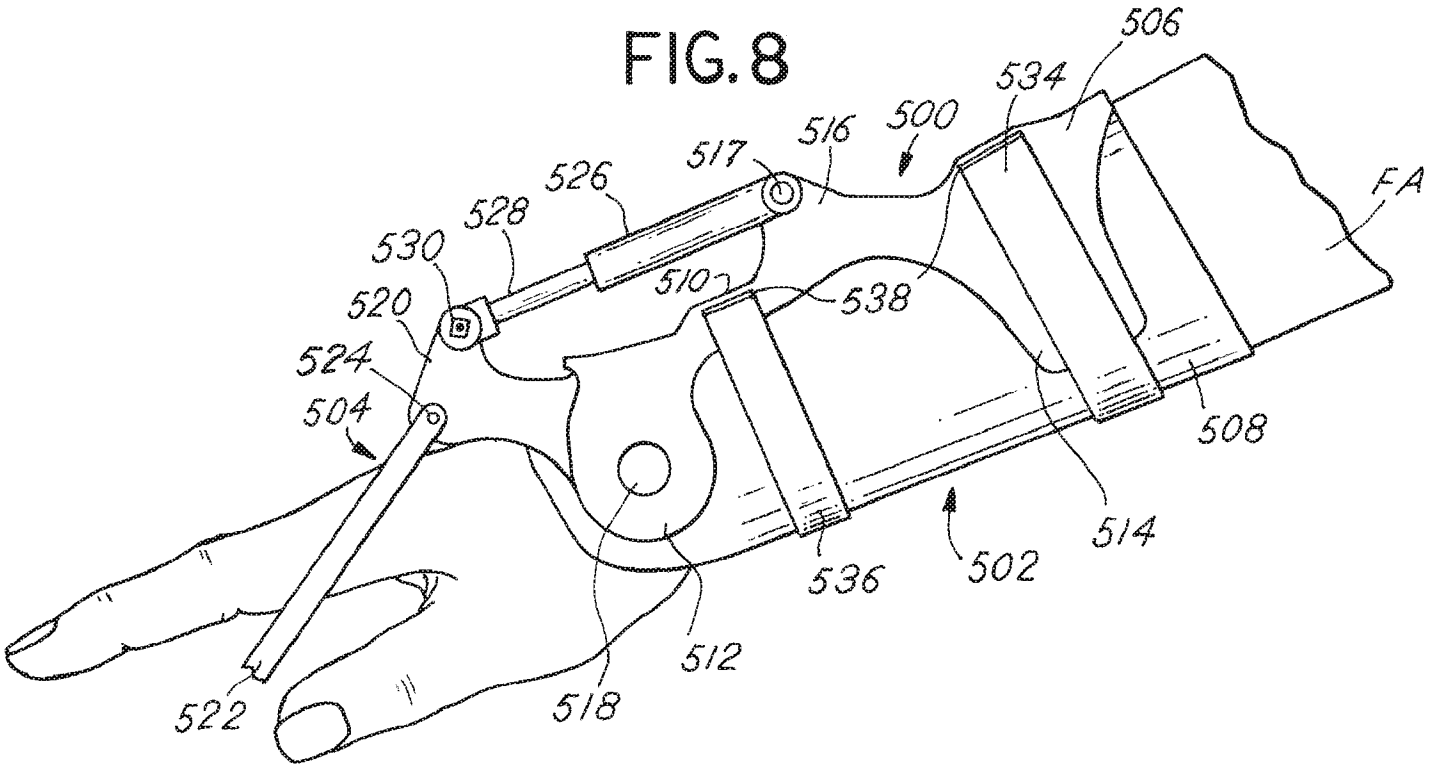
FIG. 8 is a side view of the right hand of a human operator showing another alternative of a connector for connecting the forearm to a power tool.

FIGS. 8 and 6

The device, generally 500, transfers pressure and vibration of a motorized hand tool, such as a sander S, from the hand and wrist area to the forearm FA of an operator, as is illustrated in FIG. 8. As with devices 300 and 400, only one side of the device 500 is shown but the description of the device 500 will apply to both sides thereof. The device 500 includes a brace, generally 502, and a connector, generally 504, operatively coupled to the brace 502. The connector 504 is only partially shown in FIG. 8. The brace 502 includes a shell 506, positioned over an arm wrap 508, which is placed on the forearm FA of the operator. The shell 506 includes an upper wall 510 and a pair of unitary front legs 512 (only one of which is shown in FIG. 8), projecting downwardly from the upper wall 510. The shell 506 also includes a pair of rear legs 514, which are unitary with the upper wall 510 of the shell 506. A pair of centrally positioned pivot supports 516, which project upwardly, are unitary with the upper wall 510 of the shell 506. Each of the front legs 512 of the shell 506 includes a pivot joint 518. A rocker arm 520 is pivotally mounted to each pivot joint 518 of each front leg 512.

Only a single link of a pair of links 522 of the connector 504 is shown in FIG. 8. In the device 500, the end of each link 522 is pivotally connected to the outer portion of the rocker arm 520 at a pivot 524. The opposite end of each link 522 is pivotally connected to the sander or, optionally, to another link (not shown) that, in turn, is coupled to the sander (not shown).

A pair of shock absorbers 526 (only one being shown in FIG. 8) is pivotally connected at one end by a rod 528 of each shock absorber 526 to a pivot 530 on the rocker arm 520. Oil spring cylinders may also be used in place of air spring cylinders. Alternatively, a single shock absorber may be used. The opposite end of each shock absorber 526 is pivotally connected to the pivot joint 517 provided on each pivot supports 516 of the shell 506. The shock absorbers 526 act as vibration dampers between the connector 504 to the sander S and the pivot joint 517 of the pivot supports 516.

The brace 502 includes the arm wrap 508 which is placed around the forearm FA of the operator. The arm wrap 508 includes an upper cinch strap 534 and a lower cinch strap 536, each of which is attached to the arm wrap 508. The cinch straps 534 and 536 are received within slots 538 in the upper wall 510 of the shell 506. The straps 534 and 536 secure the brace 502 to the forearm FA.

To use the device 500, such as for holding a sander with one's hand, the arm wrap 508 is secured to the forearm of the operator. As described, each shock absorber 526 is pivotally mounted to the rocker arm 520 at the pivot 530 and to the pivot support 516 at the pivot joint 517. Pressure and vibration of the sander are transmitted to the link 522, which is pivotally interconnected to the rocker arm 520. A rocker arm 520 is pivotally carried at the pivot joint 518 of each of the front legs 512.

The rocker arm 520, in turn, pivotally carries the shock absorber 526 at the pivot 530. The opposite end of the shock absorber 526 is pivotally coupled at the pivot 517. The shock absorber 526 attenuates the vibration of the sander imparted to the rocker arm 520 by the connector 504. Furthermore, the pressure and any remaining vibration bypass the wrist and hand of the operator and are instead transferred to the operator's forearm.

Device Example V

Figure 9:
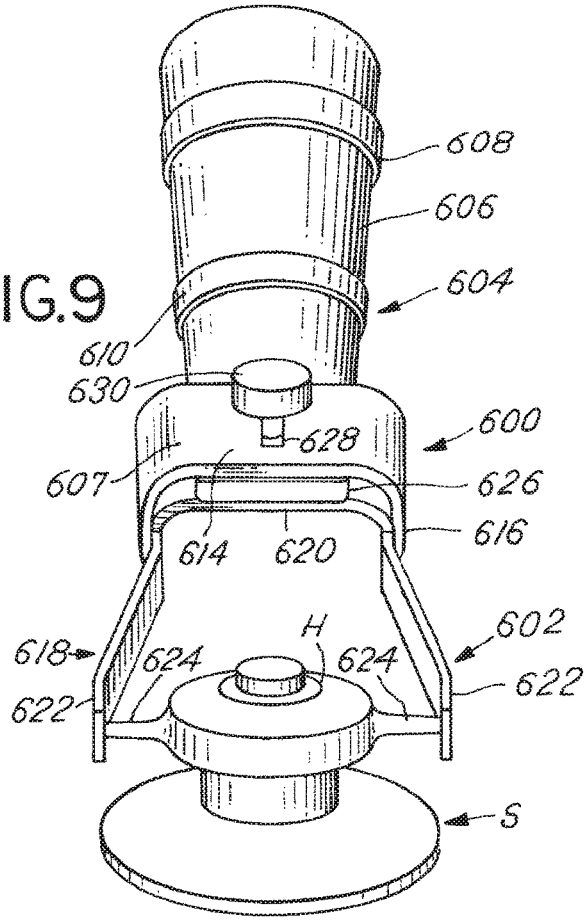
FIG. 9 is a front perspective view showing another example of the connector coupled to a power tool and another example of the brace that is connected to a forearm of the human operator.
Figure 10:
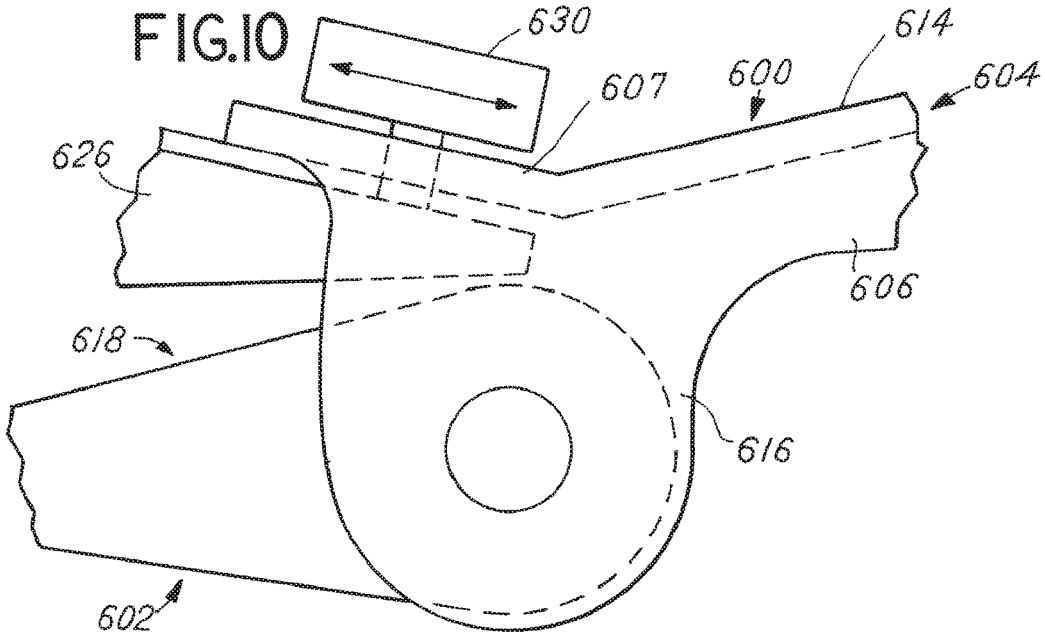
FIG. 10 is an enlarged side view showing a flexible vibration-absorbing member mounted between the power tool and the brace.

FIGS. 9 and 10

The device 600, shown in FIGS. 9 and 10, transfers pressure and vibration from a power sander S to a connector, generally 602, and then to a brace, generally 604. The brace 604 may be attached to the forearm of an operator and includes a shell section 606, which is mounted over an arm wrap (not shown), and a forward or front flange section 607. The shell section 606 and the front flange section 607 are unitary with each other. The arm wrap (not shown) is made of a flexible material that protects the skin of the operator and is similar to the arm wrap 217 of the device 200, the arm wrap 336 of the device 300, the arm wrap 406 of the device 400 and the arm wrap 508 of the device 500.

An upper cinch strap 608 and a lower cinch strap 610 of the arm wrap secure the shell 606 and arm wrap to the forearm of the operator. The cinch straps 608 and 610 are used for securing the brace 604 and the arm wrap to the operator's forearm.

The front flange section 607 of the brace 604 has a unitary upper wall 614 and a pair of opposed downwardly extending legs 616. As seen in FIG. 10, the legs 616 hingedly carry a tool linkage, generally 618. The linkage 618 has an upper flange 620, spaced just below the front flange section 607 of the brace 604. The opposite sides of the flange 620 include forwardly projecting unitary spaced tool-support arms 622.

The sander S is interconnected to a motor housing H by opposed tool mounts 624, which are fixed to the housing and also pivotally coupled to the inner sides of the support arms 622 of the tool linkage 618. Preferably, each tool mount 624 is made of a rigid or a semi-rigid material, capable of damping some of the vibration produced by the motorized tool, such as the sander S. In some types of demanding work, hard plastic may be used for the mounts 624.

As seen in FIGS. 9 and 10, a damping bumper 626 is interposed between the front flange section 607 of the brace 604 and the upper flange 620 of the tool linkage 618. The damper bumper 626 may be made of a flexible viscoelastic material, such as rubber, for absorbing vibration from the sander S. A longitudinal slot 628 is provided in the central upper portion of the front section 607 in the upper wall 614. The slot 628 receives an adjusting knob 630, threadably coupled to the damping member 626. The adjusting knob 630 is longitudinally movable in the slot 628 for adjusting the position of the damper bumper 626. The bumper 626 attenuates the vibration communicated from the linkage 618 to the shell 606.

The device 600 is attached to the forearm of the operator in a manner similar to that of the brace 402 of the device 400 and the brace 502 of the device 500. Once the brace 604 is secured to the forearm, the operator adjusts the bumper 626 in the slot 628 by moving the knob adjuster 630 relative to the slot 628. When the sander S is operating, the mounts 624 reduce the amount vibration imparted to the connector 602. The amount of vibration transmitted through the brace 604 and thereby to the forearm of the operator is further reduced by adjusting the position of the damper bumper 626. When using the device 600, the pressure and any remaining vibration are transferred from the hand and wrist to the forearm of the operator to substantially reduce the amount of fatigue and discomfort to the hand and wrist of the operator during extended periods of using the sander S or a similar motorized tool.

While the disclosure refers to certain examples, it will be understood by those skilled in the art that various changes may be made and equivalents may be substituted without departing from the spirit and scope of the present disclosure. In addition, many modifications may be made to adapt a particular situation or material to the teachings of the present disclosure without departing from its scope. Therefore, it is intended that the present disclosure not be limited to the particular examples taught, but include all examples falling within the scope of the appended claims.

What is claimed is:

1. A device (400) for transferring vibration of a motorized hand tool (S) from a hand and wrist to a forearm (FA) of a human operator when the hand grips the motorized hand tool (S) to process a surface of a workpiece (WP) with the motorized hand tool (S), the device (400) comprising:

a brace (402), configured to be coupled to the forearm (FA) of the human operator and comprising:

an arm wrap (406), configured to cover the forearm (FA) of the human operator; and a shell (408), made from a material more rigid than the arm wrap (406) and comprising two front legs (416) and an upper wall (414), wherein:

the two front legs (416) of the shell (408) are unitary with the upper wall (414) of the shell (408);

the shell (408) is coupled to the arm wrap (406); and with the two front legs (416) positioned on opposite sides of the forearm (FA) of the human operator, the shell (408) is configured to straddle the forearm (FA) of the human operator; and a connector (404), comprising two links (422), each configured to be coupled to the motorized hand tool (S) and each pivotally connected with a respective one of the two front legs (416) of the shell (408).

2. The device (400) according to claim 1, wherein each of the front legs (416) of the shell (408) comprises a pivot joint (424), pivotally coupled to a respective one of the two links (422) of the connector (404).

3. The device (400) according to claim 2, wherein with the shell (408) straddling the forearm (FA) of the human operator, the pivot joints (424) of the front legs (416) of the shell (408) are aligned with a wrist of the human operator.

4. The device (400) according to claim 1, further comprising a damping bumper (426) mounted between the two links (422) of the connector (404) and the upper wall (414) of the shell (408).

5. The device (400) according to claim 4, further comprising a bumper-adjuster knob (428), mounted on the upper wall (414) of the shell (408) and selectively operable to adjust the position of the damping bumper (426) relative to the two links (422) of the connector (404) to change an intensity of vibrations transferred to the shell (408) from the motorized hand tool (S).

6. The device (400) according to claim 1, wherein the shell (408) further comprises two rear legs (418), unitary with the upper wall (414) of the shell (408) and configured to be positioned on opposite sides of the forearm (FA) of the human operator.

7. The device (400) according to claim 6, further comprising at least one strap (412), configured to overlay the two rear legs (418).

8. The device (400) according to claim 1, further comprising at least one strap (410) securing the shell (408) to the arm wrap (406) and securing the arm wrap (406) to the forearm (FA) of the human operator.

9. The device (400) according to claim 8, wherein the upper wall (414) of the shell (408) comprises at least one slot (420), through which one of the at least one strap (410) is received.

10. The device (400) according to claim 1, further comprising a rocker arm (520), pivotally coupling the connector (504) with the shell (506).

11. The device (400) according to claim 10, wherein:

each of the front legs (512) of the shell (506) comprises a pivot joint (518);

the rocker arm (520) comprises a first pivot point (524);

the rocker arm (520) pivots about the pivot joints (518) of the front legs (512) of the shell (506); and the connector (504) pivots about the first pivot point (524) of the rocker arm (520).

12. The device (400) according to claim 11, further comprising at least one shock absorber (526), biasing the rocker arm (520) relative to the shell (506).

13. The device (400) according to claim 12, wherein;

the shell (506) further comprises at least one pivot support (516) unitary with and projecting from the upper wall (510) of the shell (506);

the rocker arm (520) comprises a second pivot point (530); and the at least one shock absorber (526) pivots about the pivot support (516) of the shell (506) and pivots about the second pivot point (530) of the rocker arm (520).

14. The device (400) according to claim 12, wherein the at least one shock absorber (526) comprises an oil spring piston-cylinder.

15. The device (400) according to claim 1, wherein the two links (622) of the connector (602) are co-rotatable relative to the shell (606).

16. The device (400) according to claim 1, wherein the two links (622) of the connector (602) are non-adjustably fixed relative to each other via a flange (620) coupled to and extending between the two links (622).

17. The device (400) according to claim 16, further comprising a damping bumper (626) mounted between the flange (620) and the shell (606).

18. The device (400) according to claim 17, wherein the shell (606) comprises an elongate slot (628) and the device (400) further comprises an adjusting knob (630), threadably coupled to the damping bumper (626) and selectively movable in the slot (628) to adjust a position of the damping bumper (626) relative to the shell (606) and the flange (620).

19. The device (400) according to claim 18, wherein the damping bumper (626) is wedge-shaped.

20. The device (400) according to claim 18, wherein selective movement of the damping bumper (626) adjusts a range of rotational motion of the connector (602) relative to the shell (606).

* * * * *